US006110634A

United States Patent [19]

Sawano et al.

[11] Patent Number: 6,110,634

[45] Date of Patent: Aug. 29, 2000

[54] ELECTROPHOTOGRAPHIC TONER

[75] Inventors: Masataka Sawano; Taito Muraoka; Yutaka Saitoh; Hiroyoshi Yamaga; Rie Murakami, all of Tsukuba, Japan

[73] Assignee: Hodogaya Chemical Co., Ltd., Kawasaki, Japan

[21] Appl. No.: 09/355,313

[22] PCT Filed: Nov. 30, 1998

[86] PCT No.: PCT/JP98/05375

§ 371 Date: Jul. 30, 1999

§ 102(e) Date: Jul. 30, 1999

[87] PCT Pub. No.: WO99/28792

PCT Pub. Date: Jun. 10, 1999

[30] Foreign Application Priority Data

Dec. 1, 1997 [JP] Japan ..... 9-329793

[51] Int. Cl.[7] ..... G03G 9/097

[52] U.S. Cl. ..... 430/110; 430/106.6

[58] Field of Search ..... 430/110, 111, 430/106, 106.6

[56] References Cited

U.S. PATENT DOCUMENTS

| | | | |
|---|---|---|---|
| 5,804,350 | 9/1998 | Sekiguchi et al. | 430/110 |
| 5,827,631 | 10/1998 | Yoshihara et al. | 430/110 |
| 5,919,866 | 7/1999 | Rao et al. | 430/110 |

*Primary Examiner*—John Goodrow
*Attorney, Agent, or Firm*—Oblon, Spivak, McClelland, Maier & Neustadt, P.C.

[57] ABSTRACT

The present invention relates to an electrophotographic toner containing a binder resin having an acid value in the range of from 0.1 to 50 and a novel compound of zirconium complex or salt useful as a charge control agent for the electrophotographic toner.

8 Claims, No Drawings

ELECTROPHOTOGRAPHIC TONER

TECHNICAL FIELD

The present invention is to provide an electrophotographic toner used to develop an electrostatic latent image in the fields of electrophotography, electrostatic recording, etc., characterized by containing a combination of a compound useful as a charge control agent and various binder resins.

BACKGROUND ART

In an image-forming process by means of an electrophotographic system, an electrostatic latent image is formed on a photoconductive material made of an inorganic or organic material, and the latent image is developed by a toner, then transferred and fixed on a paper sheet or plastic film to obtain a visible image. The photoconductive material may be positively electrifiable or negatively electrifiable depending upon its construction. When a printed portion is remained as an electrostatic latent image by exposure, development is conducted by means of an oppositely electrifiable toner. On the other hand, when a printed portion is destatisized for reversal development, development is conducted by means of an equally electrifiable toner.

A toner is composed of a binder resin, a coloring agent and other additives. However, in order to impart desired tribocharge properties (such as desired charge up speed, tribocharge level and tribocharge level stability), stability with time and environmental stability, it is common to use a charge-control agent. The properties of the toner will be substantially affected by this charge-control agent. When a positively electrifiable photoconductive material is used for development by an oppositely electrifiable toner, or when a negatively electrifiable photoconductive material is used for reversal development, a negatively electrifiable toner is used. In such a case, a negatively electrifiable charge-control agent is added. Further, in a case of a color toner for which the market is expected to expand in future, it is necessary and indispensable to use a pale-colored or preferably colorless charge-control agent which does not affect the color of the toner. Such pale-colored or colorless charge-control agents may, for example, be metal complex salt compounds of salicylic acid derivatives (e.g. JP-B-55-42752, JP-A-61-69073 and JP-A-61-221756), aromatic dicarboxylic acid metal salt compounds (e.g. JP-A-57-111541), metal complex salt compounds of anthranilic acid derivatives (e.g. JP-A-62-94856) and organic boron compounds (e.g. U.S. Pat. No. 4,767,688 and JP-A-1-306861). However, these charge-control agents have various drawbacks such that some of them are chromium compounds which are feared to be detrimental to environmental safety which is expected to be viewed as increasingly important, some of them are compounds which can not be made adequately colorless or pale-colored as required for toners, some of them have inadequate electrifying effects or provide oppositely electrifiable toners, or some of them are poor in dispersibility or chemical stability as compounds themselves. Thus, none of them has fully satisfactory properties as a charge-control agent. Accordingly, it is an object of the present invention to provide an electrophotographic toner which is excellent in the tribocharge property and capable of constantly and stably presenting an image of high image quality, characterized by using a specific combination of a binder resin and a compound which is colorless or pale-colored and excellent in environmental safety and has a high stability as a compound and which is useful as a charge-control agent for the electrophotographic toner and excellent in the dispersibility in the binder resin.

DISCLOSURE OF THE INVENTION

In order to solve these problems, the present inventors have paid an attention to zirconium (Zr) being a tetravalent metal as the main metal, and have synthesized and studied various compounds of a tetravalent cation or a bivalent cation being an oxo complex with salicylic acid or a salicylic acid derivative. As this result, they have obtained a compound which is colorless or pale-colored and is able to impart a good tribocharge property to an electrophotographic toner. Also, it has been discovered that an electrophotographic toner obtained by combining a binder resin and said compound having a good dispersibility in the binder resin under a specific condition, provides constantly and stably an image of high quality. The present invention has been accomplished on the basis of this discovery.

Namely, the present invention provides an electrophotographic toner obtained by combining a binder resin and a compound of zirconium complex or salt as a charge-control agent under a specific condition, said compound being represented by the following Formula (1):

(1)

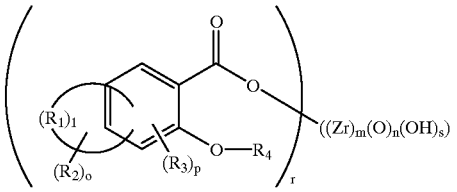

(wherein $R_1$ is quaternary carbon, methine or methylene, and may contain a hetero atom of N, S, 0 or P, and forms a cyclic structure linked by saturated bond(s) or unsaturated bond(s), each of $R_2$ and $R_3$ which are independent of each other, is an alkyl group, an alkenyl group, an alkoxy group, an aryl, aryloxy, aralkyl or aralkyloxy group which may have a substituent, a halogen group, hydrogen, a hydroxyl group, an amino group which may have a substituent, a carboxyl group, a carbonyl group, a nitro group, a nitroso group, a sulfonyl group or a cyano group, $R_4$ is hydrogen or an alkyl group, 1 is 0 or an integer of from 1 to 12, m is an integer of from 1 to 20, n is 0 or an integer of from 1 to 20, o is 0 or an integer of from 1 to 4, p is 0 or an integer of from 1 to 4, r is an integer of from 1 to 20, and s is 0 or an integer of from 1 to 20).

The electrophotographic toner of the present invention basically comprises a binder resin, a coloring agent (pigment, dye or magnetic material) and a charge control agent comprising a zirconium compound of the Formula (1). Examples of a method for preparing the above electrophotographic toner include a method which comprises placing the above mixture in a heat-mixing apparatus to melt a binder resin, kneading, cooling, roughly pulverizing, finely pulverizing and classifying, a method which comprises dissolving the above mixture in a solvent, atomizing to prepare fine particles, drying and classifying, and a method which comprises polymerizing by dispersing a coloring agent and a compound of zirconium complex or salt of the Formula (1) in suspended monomer particles.

The binder resin used in the present invention has an acid value (KOHmg/g) of from 0.01 to 50, and is a polymer or a copolymer of a monomer selected from the group consisting of a styrenic monomer, an acrylic monomer, a methacrylic monomer and their mixture, more particular examples of which include a monomer component selected from the known group consisting of styrene, o-methylstyrene, m-methylstyrene, p-methylstyrene, p-methoxystyrene, p-ethylstyrene, acrylic acid, α-ethylacrylic acid, crotonic acid, methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chlorethyl acrylate, phenyl acrylate, 2-hydroxyethyl acrylate, methacrylic acid, methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, diethylaminoethyl methacrylate, diethylaminoethyl methacrylate, 2-hydroxyethyl methacrylate, acrylo nitrile, methacrylo nitrile, acryl amide and the like.

In the case of a polyester type resin, examples of an alcohol component include known diols such as methylene glycol, propylene glycol, 1,3-butane diol, 1,4-butane diol, 2,3-butane diol, diethylene glycol, triethylene glycol, 1,5-pentane diol, 1,6-hexane diol, neopentyl glycol, 2-ethyl-1, 3-hexane diol, and bisphenol A derivatives including hydrogenated bisphenol A, and known polyhydric alcohols such as glycerin, sorbitol, sorbitan, pentaerythritol, and the like. Examples of an acid component include known benzene dicarboxylic acids or their anhydrides such as phthalic acid, terephthalic acid, isophthalic acid, phthalic anhydride and the like; alkyl dicarboxylic acids or their anhydrides such as succinic acid, adipic acid, sebacic acid, azelaic acid and the like; succinic acid or its anhydride having a $C_6$–$C_{18}$ alkyl or alkenyl group as a substituent; known unsaturated dicarboxylic acid or their anhydrides such as fumaric acid, maleic acid, citraconic acid, itaconic acid and the like; and trivalent or higher carboxylic acids or their anhydrides such as trimellitic acid, pyromellitic acid, benzophenonetetracarboxylic acid and the like. Also, a polyester may comprise an aromatic compound alone or an aliphatic compound alone.

Also, in the case of the polyester type resin, it may be partially cross-linked with an organic metal compound as described in JP-B-7-13757. Further, these binder resins may be used respectively alone or in a mixture of two or more.

Examples of a coloring agent for a black toner include carbon black for a two-component type developer and a magnetic material for one-component type developer, and examples of a coloring agent for a color toner include those illustrated below. Examples of a yellow coloring agent include well known coloring agents including an azo type organic pigment such as C.I. pigment yellow 1, C.I. pigment yellow 5, C.I. pigment yellow 12 and C.I. pigment yellow 17, an inorganic pigment such as yellow ocher, or an oil-soluble dye such as C.I. solvent yellow 2, C.I. solvent yellow 6, C.I. solvent yellow 14 and C.I. solvent yellow 19; examples of a magenta coloring agent include an azo pigment such as C.I. pigment red 57 and C.I. pigment red 57:1, a xanthene pigment such as C.I. pigment violet 1 and C.I. pigment violet 81, a thioindigo pigment such as C.I. pigment red 87, C.I. bat red 1 and C.I. pigment violet 38, or an oil-soluble dye such as C.I. solvent red 19, C.I. solvent red 49 and C.I. solvent red 52; and examples of a cyan coloring agent include a triphenylmethane pigment such as C.I. pigment blue 1, a phthalocyanine pigment such as C.I. pigment blue 15 and C.I. pigment blue 17, or an oil-soluble dye such as C.I. solvent blue 25, C.I. solvent blue 40 and C.I. solvent blue 70, and the like. Also, the compound of the complex or salt of the formula (1) may be added as a charge-control agent in an optional proportion depending on its use.

Examples of the magnetic material usable in the toner of the present invention include metal fine powder of iron, nickel or cobalt, an alloy of iron, lead, magnesium, antimony, beryllium, bismuth, cadmium, calcium, manganese, selenium, titanium, tungsten, vanadium, cobalt, copper, aluminum, nickel or zinc, a metal oxide such as aluminum oxide or titanium oxide, a ferrite of iron, manganese, nickel, cobalt or zinc, a nitride such as vanadium nitride or chromium nitride, a carbide such as tungsten carbide or silicon carbide, and a mixture of these materials. Preferable examples of the magnetic material include an oxide such as magnetite, hematite or ferrite, but the charge control agent used in the present invention provides a satisfactory electrochargeability regardless of the magnetic material used.

The compound of zirconium complex or salt used in the present invention can be generally prepared by reacting with a metal-imparting agent in the presence of water and/or an organic solvent, filtrating a reaction product and then washing the product. Examples of the metal-imparting agent usable in the preparation of this compound include, in a tetravalent cation form, a zirconium halide compound such as $ZrCl_4$, $ZrF_4$, $ZrBr_4$ and $ZrI_4$, an organic acid zirconium compound such as $Zr(OR)_4$ (wherein R is an alkyl group, an alkenyl group or the like), or an inorganic acid zirconium compound such as $Zr(SO_4)_2$, and the like. Examples of an oxo compound in a divalent cation form, include an inorganic acid zirconium compound such as $ZrOCl_2$, $ZrO(NO_3)_2$, $ZrO(ClO_4)_2$, $H_2ZrO(SO_4)_2$, $ZrO(SO_4)\cdot Na_2SO_4$, and $ZrO(HPO_4)_2$, an organic acid zirconium compound such as $ZrO(CO_3)$, $(NH_4)_2ZrO(CO_3)_2$, $ZrO(C_2H_3O_2)_2$, $(NH_4)_2ZrO(C_2H_3O_2)_3$, and $ZrO(C_{18}H_{35}O_2$, and the like.

For example, Compound No. 1 of the following Table 1 can be prepared in the following manner.

33 parts of 3, 5-di-t-butylsalicylic acid and 19 parts of 25% caustic soda were dissolved in 350 parts of water, and the mixture was heated to 50° C. with stirring, and a solution having 19 parts of zirconium oxychloride ($ZrOCl_2\cdot 8H_2O$) dissolved in 90 parts of water was dropwise added thereto (precipitation of white crystal). The resultant mixture was stirred at the same temperature for 1 hour, and was cooled to room temperature, and about 6 parts of 25% caustic soda was added thereto to adjust a pH in the range of 7.5 to 8.0. Crystal thus precipitated was filtrated out, washed with water and dried to obtain 25 parts of white crystal. This compound had a melting point of at least 300° C. The compound thus obtained was subjected to proton NMR measurement to obtain a spectrum illustrating the properties of the aimed product. The results of elemental analysis were as follows:

| | Carbon (%) | Hydrogen (%) | Nitrogen (%) | Zirconium (%) |
|---|---|---|---|---|
| Theoretical value | 49.1 | 6.6 | 0.0 | 19.9 |
| Measured value | 50.0 | 6.2 | 0.0 | 19.8 |

Further, according to IR measurement, an absorbing band resulted from Zr-OH and a hydroxyl group of salicylic acid derivative was observed at 3,200–3,600 $cm^{-1}$ and a carbonyl absorbing band showing a bond between zirconium and salicylic acid derivative was observed in the vicinity of 1,530 $cm^{-1}$. According to Raman Spectrum measurement, an absorbing band resulted from a bond formed between zirconium and 3, 5-di-t-butylsalicylic acid was observed at 700–800 $cm^{-1}$.

According to these analytical results, compound No. 1 is considered to have the following structure ($L_1$=3, 5-di-t-butylsalicylic acid).

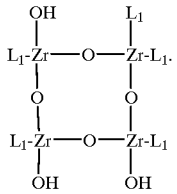

Also, Compound No. 10 of the following Table 1 can be prepared in the following manner.

100 parts of 3, 5-di-t-butylsalicylic acid and 39.0 parts of zirconium (IV) isopropoxide were dissolved in 100 parts of toluene, and were refluxed for 6 hours. The reaction mixture was cooled to room temperature, and toluene was concentrated under vacuum, and 5 parts of methanol was added to the resultant residue to precipitate crystal. The crystal thus precipitated was filtrated out, and washed with methanol and was dried to obtain 55.0 parts of white crystal. This compound had a melting point of at least 295° C. Further, this compound was subjected to proton NMR measurement to obtain a spectrum illustrating the properties of the aimed product. The results of elemental analysis of this compound were as follows:

| | Carbon (%) | Hydrogen (%) | Nitrogen (%) | Zirconium (%) |
|---|---|---|---|---|
| Theoretical value | 66.2 | 7.8 | 0.0 | 8.4 |
| Measured value | 66.4 | 7.7 | 0.0 | 8.1 |

According to these analytical results, compound No. 2 was considered to have the following structure ($L_1$=3, 5-di-t-butylsalicylic acid).

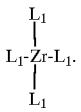

Examples of the zirconium compound of the formula (1) used in the present invention prepared as mentioned above, are illustrated in the following Table 1

TABLE 1

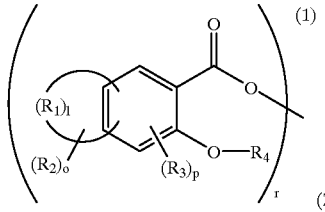

| Compound No. | | (Zr)m(O)n(OH)s | r |
|---|---|---|---|
| 1 | 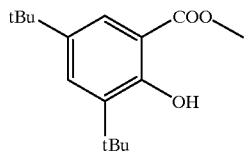 | m:4, n:4, s:3 | 5 |
| 2 | 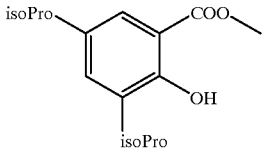 | m:4, n:4, s:3 | 5 |
| 3 | 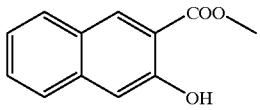 | m:4, n:4, s:3 | 5 |
| 4 | 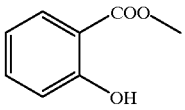 | m:4, n:4, s:3 | 5 |
| 5 | 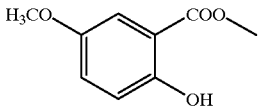 | m:4, n:4, s:3 | 5 |
| 6 | 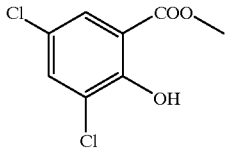 | m:4, n:4, s:3 | 5 |
| 7 | 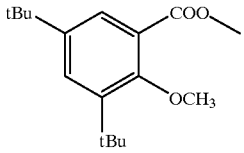 | m:4, n:4, s:3 | 5 |
| 8 | 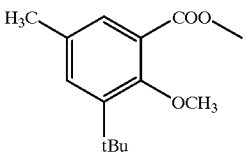 | m:4, n:4, s:3 | 5 |

TABLE 1-continued

| Compound No. | (1) | (Zr)m(O)n(OH)s | r |
|---|---|---|---|
| 9 | 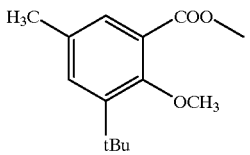 | m:1, n:0, s:0 | 4 |
| 10 | 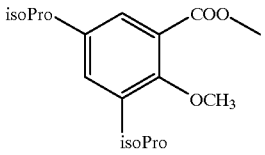 | m:1, n:0, s:0 | 4 |
| 11 | 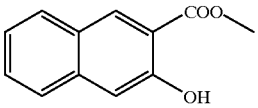 | m:1, n:0, s:0 | 4 |
| 12 | 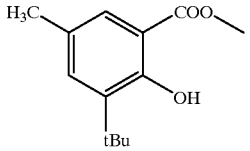 | m:1, n:0, s:0 | 4 |
| 13 | 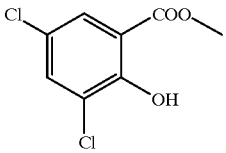 | m:1, n:0, s:0 | 4 |
| 14 | 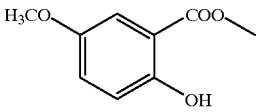 | m:1, n:0, s:0 | 4 |
| 15 | 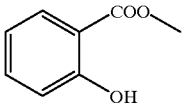 | m:1, n:0, s: | 4 |
| 16 | 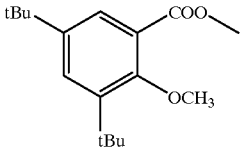 | m:1, n:0, s:0 | 4 |

The electrophotographic toner of the present invention may optionally contain other additives for protecting a photosensitive material and a carrier, improving cleaning properties, improving toner-flowing properties, adjusting thermal properties, electric properties and physical properties, adjusting resistance, adjusting a softening point and improving fixing properties, such as hydrophobic silica, a metal soap, a fluorine type surfactant, dioctyl phthalate, a wax, an electroconductivity-imparting agent including tin oxide, zinc oxide, carbon black or antimony oxide, and an inorganic fine powder such as titanium oxide, aluminum oxide or alumna. Examples of carbon black usable in the present invention include channel black, furnace black and the like, and the carbon black is usable regardless of pH, particle size and hue. Further, the carbon black is not limited to carbon black used for conventional toners, but usable if it satisfies blackness as a toner. Also, in order to impart hydrophobic properties or to control an electrified amount, the inorganic fine powder used in the present invention may optionally be treated with a treating agent such as a silicone varnish, various modified silicone vanishes, a silicone oil, various modified silicone oils, a silane coupling agent, a silane coupling agent having a functional group and other organic silicon compounds, or a mixture of these treating agents. Also, the toner of the present invention may further contain a small amount of a lubricant such as Teflon, zinc stearate and polyvinylidene fluoride, an abrasive material such as cesium oxide, silicon carbide and strontium titanate, an anti-caking agent, or white or black fine particles having a polarity opposed to that of the toner particles for improving developing properties.

In the case of using the toner of the present invention for a two-component type developer, examples of a carrier to be used include a binder type carrier having fine glass beads, iron powder, ferrite powder, nickel powder or magnetic particles dispersed in resin particles, or a resin-coated carrier having the surface of the above fine particles coated with polyester type resin, fluorine type resin, vinyl type resin, acryl type resin or silicone type resin. The toner containing the compound of the Formula (1) of the present invention provides excellent properties also when used as a one-component type toner. Further, they can be used for a capsule toner and a polymerized toner.

Examples of the magnetic material usable in the toner of the present invention include metal fine powder of iron, nickel or cobalt, an alloy of iron, lead, magnesium, antimony, beryllium, bismuth, cadmium, calcium, manganese, selenium, titanium, tungsten, vanadium, cobalt, copper, aluminum, nickel or zinc, a metal oxide such as aluminum oxide, iron oxide or titanium oxide, a ferrite of iron, manganese, nickel, cobalt or zinc, a nitride such as vanadium nitride or chromium nitride, a carbide such as tungsten carbide or silicon carbide, and a mixture of these materials. Preferable examples of the magnetic material include iron oxide such as magnetite, hematite or ferrite, but the charge control agent used in the present invention provides a satisfactory electrochargeability regardless of the magnetic material used.

BEST MODE FOR CARRYING OUT THE INVENTION

Now, the present invention is further described with reference to various Examples, but the present invention should not be limited thereto. In the following Examples, "part" means "part by weight".

EXAMPLE 1

| | |
|---|---|
| Styrene-acryl type copolymer resin (acid value: 01) (Tradename: CPR-100 manufactured by Mitsui Chemicals, Inc.) | 91 parts |
| Zirconium compound (Compound No. 1) | 1 part |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture was melt-kneaded in a heat-mixing apparatus at 140° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. A satisfactory image density could be obtained under any conditions, and fine lines could be satisfactorily reproduced with a high quality image for a long term without fogging.

EXAMPLE 2

| | |
|---|---|
| Styrene-acryl type copolymer resin (acid value: 7.7) (Tradename: CPR-300 manufactured by Mitsui Chemicals, Inc.) | 91 parts |
| Zirconium compound (Compound No. 10) | 1 part |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture was melt-kneaded in a heat-mixing apparatus at 140° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of a silicon-coat type ferrite carrier (F96-100 manufactured by Powder Tech K.K.) and the mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. A satisfactory image density could be obtained under any conditions, and fine lines could be satisfactorily reproduced with a high quality image for a long term without fogging.

EXAMPLE 3

| | |
|---|---|
| Polyester resin (acid value: 27–35) (Tradename: HP-301 manufactured by The Nippon Synthetic Chemical Industry Co., Ltd.) | 91 parts |
| Zirconium compound (Compound No. 1) | 1 part |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture was melt-kneaded in a heat-mixing apparatus at 160° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of a silicon-coat type ferrite carrier (F96-100 manufactured by Powder Tech K.K.) and the mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. A satisfactory image density could be obtained under any conditions, and fine lines could be satisfactorily reproduced with a high quality image for a long term without fogging.

EXAMPLE 4

| | |
|---|---|
| Polyester resin (acid value: 1) (Tradename: HP-313 manufactured by The Nippon Synthetic Chemical Industry Co., Ltd.) | 91 parts |
| Zirconium compound (Compound No. 1) | 1 part |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture was melt-kneaded in a heat-mixing apparatus at 160° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. A satisfactory image density could be obtained under any conditions, and fine lines could be satisfactorily reproduced with a high quality image for a long term without fogging.

EXAMPLE 5

| | |
|---|---|
| Styrene-acryl type copolymer resin (acid value: 2.0) (Tradename: FB-1258 manufactured by Mitsubishi Rayon Co., Ltd.) | 91 parts |
| Zirconium compound (Compound No. 2) | 1 part |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture was melt-kneaded in a heat-mixing apparatus at 140° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. A satisfactory image density could be obtained under any conditions, and fine lines could be satisfactorily reproduced with a high quality image for a long term without fogging.

EXAMPLE 6

| | |
|---|---|
| Polyester resin (acid value: 11.0) (Tradename: FC-316 manufactured by Mitsubishi Rayon Co., Ltd.) | 91 parts |
| Zirconium compound (Compound No. 10) | 1 part |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture was melt-kneaded in a heat-mixing apparatus at 160° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. A satisfactory image density could be obtained under any conditions, and fine lines could be satisfactorily reproduced with a high quality image for a long term without fogging.

EXAMPLE 7

| | |
|---|---|
| Styrene-acryl type copolymer resin (acid value: 0.2) (Tradename: Hi-mer TB-1000F manufactured by Sanyo Chemical Industries, LTD.) | 91 parts |
| Zirconium compound (Compound No. 3) | 1 part |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture was melt-kneaded in a heat-mixing apparatus at 150° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. A satisfactory image density could be obtained under any conditions, and fine lines could be satisfactorily reproduced with a high quality image for a long term without fogging.

EXAMPLE 8

| | |
|---|---|
| Polyester resin (acid value: 11.0) (Tradename FC-316 manufactured by Mitsubishi Rayon Co., Ltd.) | 91 parts |
| Zirconium compound (Compound No. 3) | 1 part |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture was melt-kneaded in a heat-mixing apparatus at 160° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. A satisfactory image density could be obtained under any conditions, and fine lines could be satisfactorily reproduced with a high quality image for a long term without fogging.

EXAMPLE 9

| | |
|---|---|
| Styrene-acryl tape copolymer resin (acid value: 0.1) (Tradename: CPR-100 manufactured by Mitsui Chemicals, Inc.) | 50 parts |
| Zirconium compound (Compound No. 1) | 2 parts |
| Magnetic powder | 45 parts |
| Low molecular weight polypropylene (Tradename: Viscol 550p manufactured by Sanyo Chemical Industries, LTD.) | 3 parts |

The above mixture was melt-kneaded in a heat-mixing apparatus at 140° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. A satisfactory image density could be obtained under any conditions, and fine lines could be satisfactorily reproduced with a high quality image for a long term without fogging.

EXAMPLE 10

| | |
|---|---|
| Polyester resin (acid value: 27–35) (Tradename: HP-313 manufactured by The Nippon Synthetic Chemical Industry Co., Ltd.) | 50 parts |
| Zirconium compound (Compound No. 1) | 2 parts |
| Magnetic powder | 45 parts |
| Low molecular weight polypropylene (Tradename: Viscol 550p manufactured by Sanyo Chemical Industries, LTD.) | 3 parts |

The above mixture was melt-kneaded in a heat-mixing apparatus at 160° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. A satisfactory image density could be obtained under any conditions, and fine lines could be satisfactorily reproduced with a high quality image for a long term without fogging.

COMPARATIVE EXAMPLE 1

| | |
|---|---|
| Styrene-acryl type copolymer resin (acid value: 0.1) (Tradename: CPR-100 manufactured by Mitsui Chemicals, Inc.) | 92 parts |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture containing no zirconium compound was melt-kneaded in a heat-mixing apparatus at 140° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. An image density was not stable, and there was a fogging phenomenon. Thus, practically useful results could not be obtained.

COMPARATIVE EXAMPLE 2

| | |
|---|---|
| Styrene-acryl type copolymer resin (acid value: 55) | 91 parts |
| Zirconium compound (Compound No. 1) | 1 part |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture containing a previously prepared styrene-acryl type copolymer resin having an acid value of 55 was melt-kneaded in a heat-mixing apparatus at 140° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. An image density was not stable, and there was a fogging phenomenon. Thus, practically useful results could not be obtained.

COMPARATIVE EXAMPLE 3

| | |
|---|---|
| Polyethyrene resin (acid value: 1) (Tradename: HP-313 manufactured by The Nippon Synthetic Chemical Industry Co., Ltd.) | 92 parts |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture containing no zirconium compound was melt-kneaded in a heat-mixing apparatus at 160° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. An image density was not stable, and there was a fogging phenomenon. Thus, practically useful results could not be obtained.

COMPARATIVE EXAMPLE 4

| | |
|---|---|
| polyester resin (acid value: 60) | 91 parts |
| Zirconium compound (Compound No. 10) | 1 part |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture containing a previously prepared polyester resin having an acid value of 60 was melt-kneaded in a heat-mixing apparatus at 160° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. An image density was not stable, and there was a fogging phenomenon. Thus, practically useful results could not be obtained.

COMPARATIVE EXAMPLE 5

| | |
|---|---|
| Styrene-acryl type copolymer resin (acid value: 55) | 91 parts |
| Zirconium compound (Compound No. 3) | 1 part |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries. LTD.) | 3 parts |

The above mixture containing a previously prepared styrene-acryl type copolymer resin having an acid value of 55 was melt-kneaded in a heat-mixing apparatus at 140° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test. The results are shown in the following Table 2. An image density was not stable, and there was a fogging phenomenon. Thus, practically useful results could not be obtained.

COMPARATIVE EXAMPLE 6

| | |
|---|---|
| Polyester resin (acid value: 60) | 91 parts |
| Zirconium compound (Compound No. 3) | 1 part |
| Carbon black (Tradename: MA-100 manufactured by Mitsubishi Chemical Corporation) | 5 parts |
| Low molecular weight polypropylene (Tradename: Viscol 550p manufactured by Sanyo Chemical Industries, LTD.) | 3 parts |

The above mixture containing previously prepared polyester resin having an acid value of 60 was melt-kneaded in a heat-mixing apparatus at 160° C., and the kneaded product was cooled and was roughly pulverized by a hammer mill. The resultant product was further finely pulverized by a jet mill and was classified to obtain a black toner having a particle size of from 10 to 12 μm. 4 parts of the toner thus obtained was mixed with 100 parts of silicon-coat type ferrite carrier (F96-100 manufactured by Powder Tech K.K.) and the resultant mixture was agitated to obtain a toner negatively charged and the charged amount was measured by a blow-off powder charged amount-measuring apparatus. The toner thus obtained was applied to a modified commercially available copying machine to carry out an image test.

Since there was a fogging phenomenon, practically useful results could not be obtained. The results are shown in the following Table 2.

COMPARATIVE EXAMPLE 7

| | |
|---|---|
| Styrene-acryl type copolymer resin (acid value: 0.1) (Tradename: CPR-100 manufactured by Mitsui Chemicals, Inc.) | 52 parts |
| Magnetic powder | 45 parts |
| Low molecular weight polypropylene (Tradename: Viscol 550p manufactured by Sanyo Chemical Industries, LTD.) | 3 parts |

A developer was prepared and an image evaluation was carried out in the same manner as in Example 9, except that a zirconium compound was not contained in the above mixture. The results are shown in the following Table 2. An image density was not stable, and there was a fogging phenomenon. Thus, practically useful results could not be obtained.

COMPARATIVE EXAMPLE 8

| | |
|---|---|
| Polyester resin (acid value: 27–35) (Tradename: HP-313 manufactured by The Nippon Synthetic Chemical Industry Co., Ltd.) | 52 parts |
| Magnetic powder | 45 parts |
| Low molecular weight polypropylene (Tradename: Viscol 550p manufactured by Sanyo Chemical Industries, LTD.) | 3 parts |

A developer was prepared and an image evaluation was carried out in the same manner as in Example 9, except that a zirconium compound was not contained in the above mixture. The results are shown in the following Table 2. An image density was not stable, and there was a fogging phenomenon. Thus, practically useful results could not be obtained.

TABLE 2

| | | | | Evaluation of toner | | | | | |
|---|---|---|---|---|---|---|---|---|---|
| | | | | Charged amount μC/g | | Quality of image | | | |
| Examples | Kind of resin (Tradename) | Acid value (Tg° C.) | Charge control agent | Initial stage | Stage of copying 50,000 sheets | Initial stage | Stage of copying 50,000 sheets | Environmental stability | Fogging scattering of toner |
| Examples 1 | SA (CPR-100) | 0.1 (60.4) | Compound No. 1 | −23.5 | −23 | ○ | ○ | ○ | ○ ○ |
| Examples 2 | SA (CPR-300) | 7.7 (50.8) | Compound No. 10 | −22.8 | −22.6 | ○ | ○ | ○ | ○ ○ |
| Examples 3 | PE (HP-301) | 27–35 (60–64) | Compound No. 1 | −25.2 | −23.5 | ○ | ○ | ○ | ○ ○ |
| Examples 4 | PE (HP-313) | 1 (62–66) | Compound No. 1 | −22 | −21.8 | ○ | ○ | ○ | ○ ○ |
| Examples 5 | SA (FB-1258) | 2 (56) | Compound No. 2 | −22.8 | −22 | ○ | ○ | ○ | ○ ○ |
| Examples 6 | PE (FC-316) | 11 (70.7) | Compound No. 10 | −19.1 | −19.8 | ○ | ○ | ○ | ○ ○ |
| Examples 7 | SA (TB-1000F) | 0.2 (58) | Compound No. 3 | −19.4 | −19.8 | ○ | ○ | ○ | ○ ○ |
| Examples 8 | PE (FC-316) | (70.7) | Compound No. 3 | −20.8 | −21.2 | ○ | ○ | ○ | ○ ○ |
| Examples 9 | SA (CPR-100) | 0.1 (60.4) | Compound No. 1 | −19.8 | −20.0 | ○ | ○ | ○ | ○ ○ |
| Examples 10 | PE (HP-313) | 27–35 (62–64) | Compound No. 1 | −18.5 | −18.2 | ○ | ○ | ○ | ○ |
| Comparative Example 1 | SA (CPR-100) | (60.4) | | −2.5 | −5.5 | x | x | x | x x |
| Comparative Example 2 | SA | 55 (60–64) | Compound No. 1 | −18.7 | −14 | Δ | Δ | Δ | Δ Δ |
| Comparative Example 3 | PE (HP-313) | 1 (62–64) | | −3 | −2.5 | x | x | x | x x |
| Comparative Example 4 | PE | 50 (60–64) | Compound No. 10 | −19.4 | −14 | ○ | Δ | Δ | Δ Δ |
| Comparative Example 5 | SA | 55 (60–64) | Compound No. 3 | −17.3 | −15.1 | ○ | Δ | Δ | Δ Δ |
| Comparative Example 6 | PE | 60 | Compound No. 3 | −17 | −14.3 | ○ | Δ | Δ | Δ Δ |
| Comparative Example 7 | SA (CPR-100) | 0.1 (60.4) | | −1.5 | −2.0 | x | x | x | x x |
| Comparative Example 8 | PE (HP-313) | 27–35 (62–64) | | −2.6 | −3.5 | x | x | x | x x |

As evident from the above Table, in the Comparative Examples, an image density was not stable, and there was a fogging phenomenon. Thus, practically useful results could not be obtained.

INDUSTRIAL APPLICABILITY

The zirconium complex or salt of the formula (1) used in the present invention is a colorless or pale color compound having a high stability, and an electrophotographic toner containing this compound and a binder resin having specific acid value and glass transition point can provide constantly and stably an image of high quality.

What is claimed is:

1. An electrophotographic toner comprising a binder resin and a compound of zirconium complex or salt as a charge control agent, wherein the binder resin has an acid value in the range of from 0.09 to 50, and the charge control agent is a compound represented by the Formula (1):

(1)

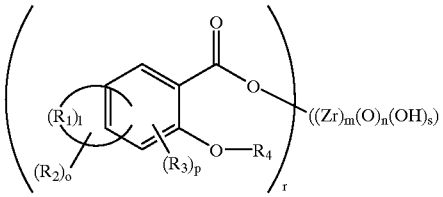

wherein $R_1$ is quaternary carbon, methine or methylene, and may contain a hetero atom of N, S, O or P, and forms a cyclic structure linked by saturated bond(s) or unsaturated bond(s), each of $R_2$ and $R_3$ which are independent of each other, is an alkyl group, an alkenyl group, an alkoxy group, an aryl, aryloxy, aralkyl or aralkyloxy group which may have a substituent, a halogen group, hydrogen, a hydroxyl group, an amino group which may have a substituent, a carboxyl group, a carbonyl group, a nitro group, a nitroso group, a sulfonyl group or a cyano group, $R_4$ is hydrogen or an alkyl group, 1 is 0 or an integer of from 1 to 12, m is an integer of from 1 to 20, n is 0 or an integer of from 1 to 20, o is 0 or an integer of from 1 to 4, p is 0 or an integer of from 1 to 4, r is an integer of from 1 to 20, and s is an integer of from 1 to 20.

2. The electrophotographic toner according to claim 1, wherein the binder resin is a copolymer or a homopolymer of a monomer selected from the group consisting of a styrenic monomer, an acrylic monomer, a methacrylic monomer and a mixture thereof.

3. The electrophotographic toner according to claim 1, wherein the binder resin is a polyester containing at least one alcohol component selected from the group consisting of a dihydric alcohol and a polyhydric alcohol and at least one acid component selected from the group consisting of a dicarboxylic acid, a polycarboxylic acid and their anhydrides.

4. The electrophotographic toner according to claim 1, wherein the binder resin has a glass transition point of 40 to 10° C., a number average molecular weight (Mn) of 1,500 to 50,000 and a weight average molecular weight of (Mw) of 10,000 to 3,000,000.

5. The electrophotographic toner according to claim 1, wherein the toner contains a magnetic powder.

6. The electrophotographic toner according to claim 2, wherein the charge control agent is contained in an amount of from 0.01 to 10 parts by weight to 100 parts by weight of the binder resin and has an average particle size of from 0.01 to 10 $\mu$m.

7. The electrophotographic toner according to claim 2, wherein the binder resin has a glass transition point 40–90° C., a number average molecular weight (Mn) of 1,500 to 500,000 and a weight average molecular weight (Mw) of 10,000 to 3,000,000.

8. The electrophotographic toner according to claim 3, wherein the charge control agent is contained in an amount of from 0.01 to 10 parts by weight to 100 parts by weight of the binder resin and has an average particle size of from 0.01 to 10 $\mu$m.

* * * * *